US007238053B1

(12) United States Patent
Liu et al.

(10) Patent No.: US 7,238,053 B1
(45) Date of Patent: Jul. 3, 2007

(54) NON-WELDING MICRO SD CARD

(75) Inventors: Chin-Chun Liu, Miaoli County (TW); Shih-Tung Liu, Miaoli County (TW)

(73) Assignee: Sun-Light Electronic Technologies Inc., Taipei (TW)

( * ) Notice: Subject to any disclaimer, the term of this patent is extended or adjusted under 35 U.S.C. 154(b) by 0 days.

(21) Appl. No.: 11/698,836

(22) Filed: Jan. 29, 2007

(51) Int. Cl.
*H01R 24/00* (2006.01)

(52) U.S. Cl. ..... 439/630; 439/874; 439/945

(58) Field of Classification Search ..... 439/945, 439/630, 638
See application file for complete search history.

(56) References Cited

U.S. PATENT DOCUMENTS 7,033,223 B1 * 4/2006 Lin ..... 439/630
7,052,295 B1 * 5/2006 Lin ..... 439/159
7,059,871 B1 * 6/2006 Hsiao ..... 439/76.1
2006/0254937 A1 * 11/2006 Liu ..... 206/307

* cited by examiner

*Primary Examiner*—Briggitte R. Hammond

(57) ABSTRACT

A MICRO SD card includes a casing composed of a base and a top cover, an insertion slot is defined in an end of the casing and a plurality of first recesses are defined in an inner surface of the base. A recessed area is defined in the inner surface of the base so as to receive a circuit board therein. The top cover has a plurality of ridges extending from an underside thereof and each ridge has a second recess defined therein. A plurality of terminals each have a projection which is engaged with one of the second recesses. A first leg and a second leg respectively extend from two ends of each of the projections. The first leg extends into the insertion slot and the second leg has a protrusion which is compressed onto the circuit board by the ridge corresponding thereto.

3 Claims, 3 Drawing Sheets

NON-WELDING MICRO SD CARD

BACKGROUND OF THE INVENTION (1) Field of the Invention

The present invention relates to a non-welding connection between terminals and the circuit board.

(2) Description of the Prior Art

A conventional MICRO SD card is compact and convenient to use so that the MICRO SD cards are welcomed by users. In order to secure the connection between the terminals and the circuit board of the MICRO SD card, the terminals are welded to the circuit board and the conventional way to secure the connection involves complicated processes and high manufacturing cost. One end of each of the terminals has to be welded to the circuit board before being packed in the casing, because the terminals are so tiny and only a small gap is defined between the terminals so that it is difficult to perfectly weld the tiny terminals on the desired positions on the circuit board.

The present invention intends to provide a connection between the terminals and the circuit board for MICRO SD cards and the terminals each have a protrusion on one end thereof and the protrusion is compressed onto the circuit board by the top cover of the casing so that the terminals are positioned without welding.

SUMMARY OF THE INVENTION

The present invention relates to a MICRO SD card which comprises a casing composed of a base and a top cover which is mounted on the base. An insertion slot is defined in an end of the casing and a plurality of first recesses are defined in an inner surface of the base. A recessed area is defined in the inner surface of the base and a circuit board is received in the recessed area. The top cover has a plurality of ridges extending from an underside thereof and each of the ridges has a second recess defined therein. A plurality of terminals each have a projection which is engaged with one of the second recesses. A first leg and a second leg respectively extend from two ends of each of the projections. The first leg extends into the insertion slot and the second leg has a protrusion extending toward a direction opposite to the projection. The protrusion is compressed onto the circuit board by the ridge corresponding thereto.

The primary object of the present invention is to provide a MICOR SD card wherein the terminals are in contact with the circuit board without welding processes.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENTS

Figure 1:
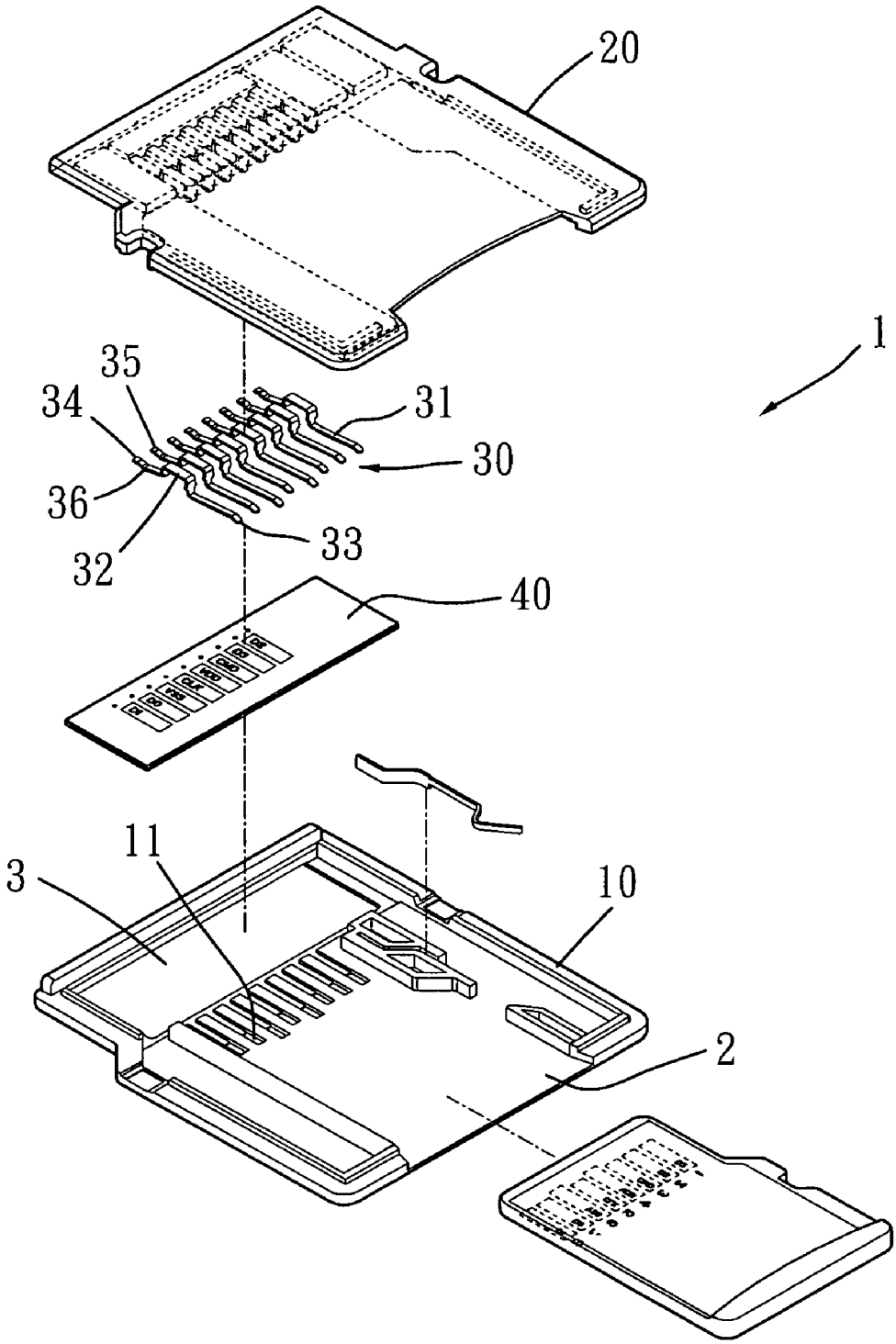
FIG. 1 is an exploded view to show a MICOR SD card of the present invention.
Figure 2:
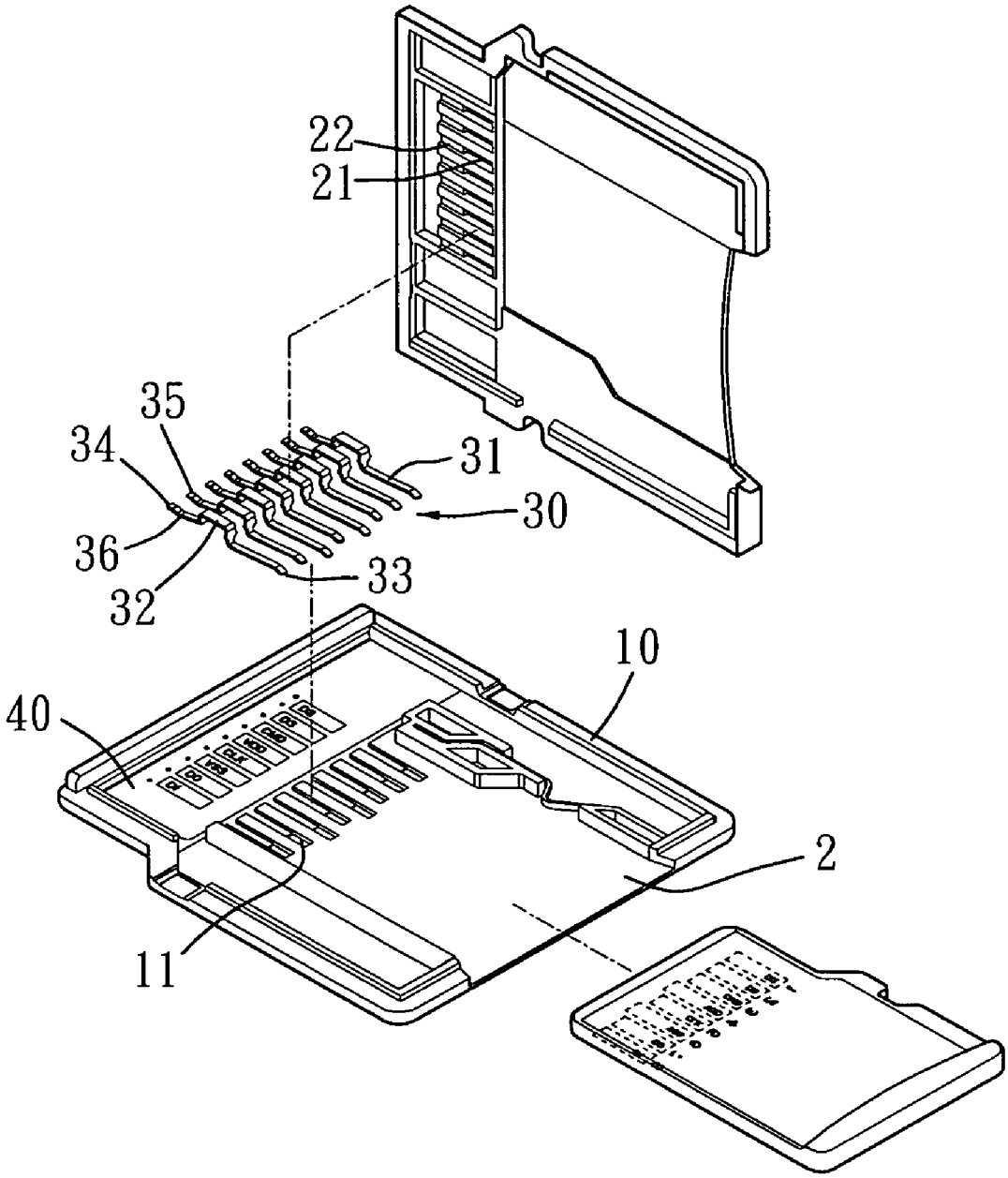
FIG. 2 is an exploded view to show the MICOR SD card of the present invention, wherein the circuit board is engaged with the base.
Figure 3:
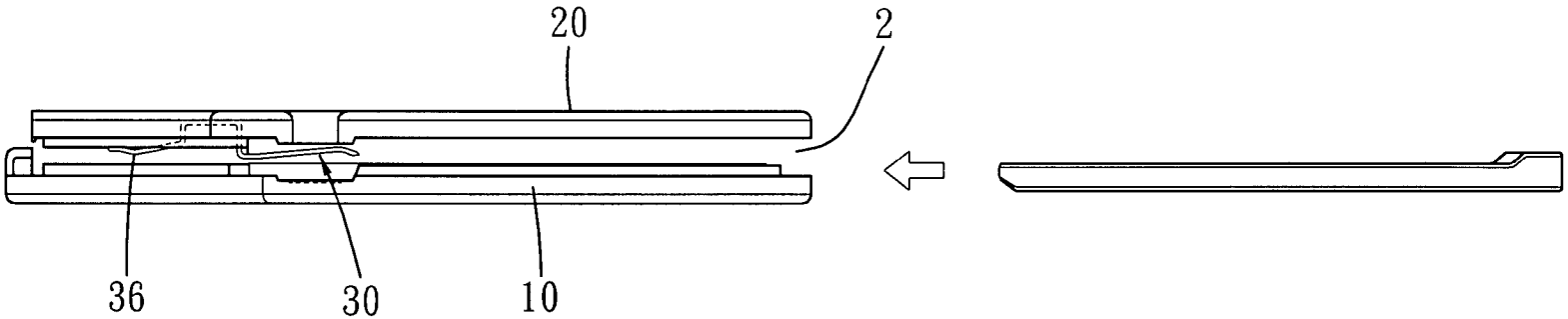
FIG. 3 shows a side view to show that the top cover is to be connected to the base, and an insertion card is to be inserted into the MICOR SD card of the present invention.

Referring to FIGS. 1 to 4, the MICOR SD card of the present invention comprises a MINI SD casing 1 composed of a base 10 and a top cover 20 which is connected on the base 10 by way of ultra sonic soldering. An insertion slot 2 is defined in an end of the casing 1 and a plurality of first recesses 11 are defined in an inner surface of the base 10. A recessed area 3 is defined in the inner surface of the base 10 and a circuit board 40 is received in the recessed area 3. The top cover 20 has a plurality of ridges 22 extending from an underside thereof and each of the ridges 22 has a second recess 21 defined therein. The ridges 22 are located corresponding to the circuit board 40.

Figure 4:
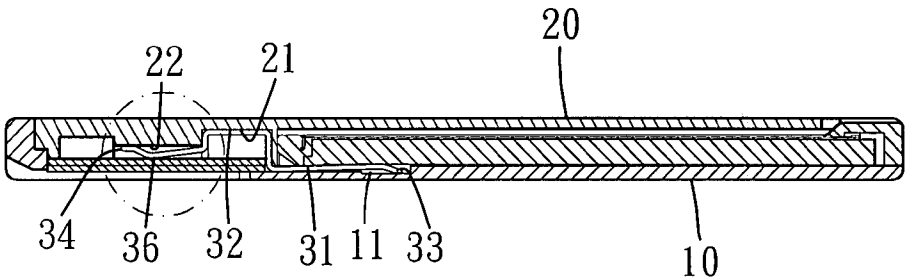
FIG. 4 is a cross sectional view to show the MICOR SD card of the present invention wherein the insertion card is inserted into the MICOR SD card.
Figure 4A:
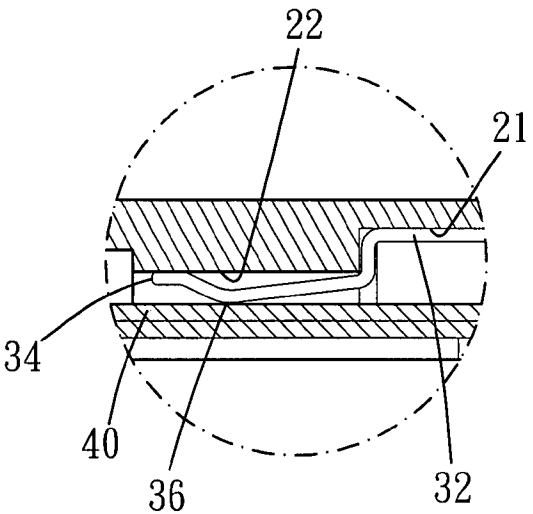
FIG. 4A is an enlarged cross sectional view to show that the protrusion of the terminal is compressed onto the circuit board in the MICOR SD card of the present invention.

A plurality of terminals 30 each have a projection 32 which is engaged with one of the second recesses 21. A first leg 33 and a second leg 34 respectively extend from two lower ends of each of the projections 32. The first leg 33 extends into the insertion slot 2 and a distal end of each of the first legs 33 extends in a direction opposite to the projection 32. The second leg 34 has a protrusion 36 extending toward a direction opposite to the projection 32. The protrusion 36 is compressed onto the circuit board 40 by the ridge 22 corresponding thereto so that no welding process is needed. The protrusion 36 is in contact with a desired point on the circuit board 40. A distal end 35 of the second leg 34 extends in a direction opposite to the protrusion 36 and in contact with an underside of the ridge 22 corresponding thereto. When an insertion card is inserted into the insertion slot 2, because the distal end of each of the first legs 33 extends in a direction opposite to the projection 32, so that the insertion card pushes the distal end into the first recess 11 as shown in FIG. 4 and the first leg 33 is in contact with the insertion card.

The terminals 30 do not need any welding process to be connected with the circuit board 40 and this simplifies the manufacturing processes and the MICRO SD card can be assembled within a short period of time.

While we have shown and described the embodiment in accordance with the present invention, it should be clear to those skilled in the art that further embodiments may be made without departing from the scope of the present invention.

What is claimed is:

1. A MICRO SD card comprising:

a casing composed of a base and a top cover which is mounted on the base, an insertion slot defined in an end of the casing and a plurality of first recesses defined in an inner surface of the base, a recessed area defined in the inner surface of the base and a circuit board received in the recessed area, the top cover having a plurality of ridges extending from an underside thereof, each of the ridges having a second recess defined therein, the ridges being located corresponding to the circuit board, and a plurality of terminals each having a projection which is engaged with one of the second recesses, a first leg and a second leg respectively extending from two lower ends of each of the projections, the first leg extending into the insertion slot and the second leg having a protrusion extending toward a direction opposite to the projection, the protrusion being compressed onto the circuit board by the ridge corresponding thereto, a distal end of the second leg extending in a direction opposite to the protrusion and in contact with an underside of the ridge corresponding thereto.

2. The MICRO SD card as claimed in claim 1, wherein a distal end of each of the first legs extends in a direction opposite to the projection.

3. The MICRO SD card as claimed in claim 1, wherein the base and the top cover are connected with each other by way of ultra sonic soldering.

* * * * *